US011205407B2

(12) United States Patent
Yoshino et al.

(10) Patent No.: US 11,205,407 B2
(45) Date of Patent: Dec. 21, 2021

(54) SONG ANALYSIS DEVICE AND SONG ANALYSIS PROGRAM

(71) Applicant: AlphaTheta Corporation, Yokohama (JP)

(72) Inventors: Hajime Yoshino, Yokohama (JP); Toshihisa Sabi, Yokohama (JP)

(73) Assignee: ALPHATHETA CORPORATION, Yokohama (JP)

( * ) Notice: Subject to any disclaimer, the term of this patent is extended or adjusted under 35 U.S.C. 154(b) by 0 days.

(21) Appl. No.: 16/641,969

(22) PCT Filed: Aug. 29, 2017

(86) PCT No.: PCT/JP2017/031000
§ 371 (c)(1),
(2) Date: Feb. 25, 2020

(87) PCT Pub. No.: WO2019/043798
PCT Pub. Date: Mar. 7, 2019

(65) Prior Publication Data

US 2020/0193947 A1 Jun. 18, 2020

(51) Int. Cl.
*G10H 1/00* (2006.01)
*G10G 3/04* (2006.01)

(52) U.S. Cl.
CPC ..... *G10H 1/0008* (2013.01); *G10G 3/04* (2013.01); *G10H 2210/076* (2013.01); *G10H 2210/086* (2013.01); *G10H 2250/055* (2013.01)

(58) Field of Classification Search
CPC ..... G10H 1/00; G10H 1/0008; G10H 1/0025; G10H 2210/076; G10H 2210/151;
(Continued)

(56) References Cited

U.S. PATENT DOCUMENTS

2005/0211072 A1* 9/2005 Lu ..... G10H 1/40 84/612
2005/0247185 A1 11/2005 Uhle
(Continued)

FOREIGN PATENT DOCUMENTS

JP 2008-275975 11/2003
JP 2007-536586 12/2007
(Continued)

OTHER PUBLICATIONS

Kazuyoshi Yoshii et al., "An Error Correction Method of Drum Sound Recognition by Estimating Drum Patterns", IPSJ SIG Notes, Aug. 5, 2005 (Aug. 5, 2005), vol. 2005, No. 82, pp. 91 to 96, Listed in International Search Report, 7 pages.
(Continued)

*Primary Examiner* — Marlon T Fletcher
(74) *Attorney, Agent, or Firm* — Rankin, Hill & Clark LLP

(57) ABSTRACT

A music piece analyzer includes: a beat interval acquiring unit configured to acquire a beat interval in music piece data; a candidate detector configured to detect sounding positions where a change amount for sounding is equal to or more than a predetermined threshold in the music piece data, as candidates for sounding positions of a snare drum; and a sounding position determination unit configured to determine that the candidates for the sounding positions at a two-beat interval acquired by the beat interval acquiring unit in the music piece data are the sounding positions of the snare drum, among the candidates for the sounding positions of the snare drum.

5 Claims, 14 Drawing Sheets

(58) Field of Classification Search
CPC ..... G10H 2210/066; G10H 2210/145; G10H 2230/331; G10H 2220/081; G10H 2220/121
See application file for complete search history.

(56) References Cited

U.S. PATENT DOCUMENTS

| | | | | |
|---|---|---|---|---|
| 2006/0200847 | A1* | 9/2006 | Miyajima | H04N 21/4131 725/89 |
| 2008/0034947 | A1* | 2/2008 | Sumita | G10H 1/383 84/613 |
| 2010/0211200 | A1* | 8/2010 | Kobayashi | G06F 3/165 700/94 |
| 2014/0337021 | A1* | 11/2014 | Kim | G10L 25/81 704/228 |
| 2015/0068389 | A1* | 3/2015 | Sugano | G06F 16/639 84/611 |
| 2019/0090328 | A1* | 3/2019 | Sakagami | A63J 17/00 |
| 2019/0341010 | A1* | 11/2019 | Wipperfurth | G06F 3/165 |
| 2020/0193947 | A1* | 6/2020 | Yoshino | G10H 1/40 |
| 2020/0335074 | A1* | 10/2020 | Lou | G10H 1/0008 |
| 2020/0357368 | A1* | 11/2020 | Yoshino | G10H 1/0008 |

FOREIGN PATENT DOCUMENTS

| | | |
|---|---|---|
| JP | 2008-275975 | 11/2008 |
| JP | 2014-16552 | 1/2014 |
| JP | 2015-079151 | 4/2015 |
| JP | 2015-125239 | 7/2015 |
| JP | 2015-200685 | 11/2015 |

OTHER PUBLICATIONS

International Search Report, dated Nov. 21, 2017 (dated Nov. 21, 2017), 2 pages.

* cited by examiner

SONG ANALYSIS DEVICE AND SONG ANALYSIS PROGRAM

TECHNICAL FIELD

The present invention relates to a music piece analyzer and a music piece analysis program.

BACKGROUND ART

It has been typically known to extract specific instrumental sounds from music piece data and analyze a music piece in terms of a beat position, bar position and the like on a basis of a rhythm pattern and the like of the extracted instrumental sounds.

Patent Literature 1 discloses a technique of extracting an attack sound of a snare drum to differentiate the attack sound from instrumental sounds (e.g., voice and piano) other than the snare drum, by subtracting amplitude data of the music piece after an elapse of a predetermined time from an attack position of the snare drum.

CITATION LIST

Patent Literature(s)

Patent Literature 1: JP2015-125239 A

SUMMARY OF THE INVENTION

Problem(s) to be Solved by the Invention

However, since various instrumental sounds coexist in the music piece data, the technique of Patent Literature 1 cannot necessarily accurately specify sounding positions of the snare drum.

An object of the invention is to provide a music piece analyzer and a music piece analysis program, which are capable of accurately specifying sounding positions of a snare drum from music piece data.

Means for Solving the Problems

According to an aspect of the invention, a music piece analyzer includes: a beat interval acquiring unit configured to acquire a beat interval of music piece data; a candidate detector configured to detect sounding positions where a change amount for sounding is equal to or more than a predetermined threshold in the music piece data, as candidates for sounding positions of the snare drum; and a sounding position determination unit configured to determine that the candidates for the sounding positions at a two-beat interval calculated by the beat interval acquiring unit in the music piece data are the sounding positions of the snare drum, among the candidates for the sounding positions of the snare drum.

According to another aspect of the invention, a music piece analysis program enables a computer to function as: a beat interval acquiring unit configured to acquire a beat interval of music piece data; a candidate detector configured to detect sounding positions where a change amount for sounding is equal to or more than a predetermined threshold in the music piece data, as candidates for sounding positions of the snare drum; and a sounding position determination unit configured to determine that the candidates for the sounding positions at a two-beat interval calculated by the beat interval acquiring unit in the music piece data are the sounding positions of the snare drum, among the candidates for the sounding positions of the snare drum.

BRIEF DESCRIPTION OF DRAWING(S)

DESCRIPTION OF EMBODIMENT(S)

1. Concept of Invention

Figure 1A:
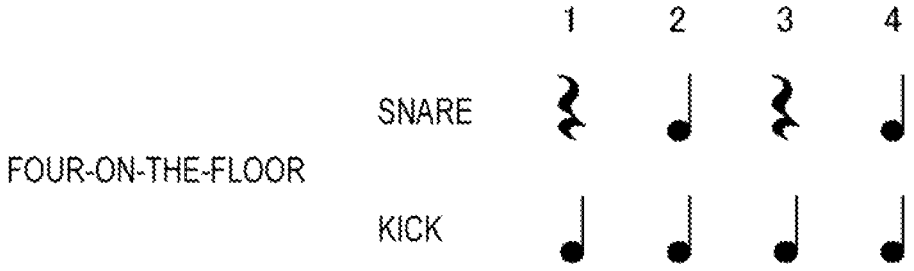
FIG. 1A is a schematic illustration for explaining a concept of the invention.
Figure 1B:
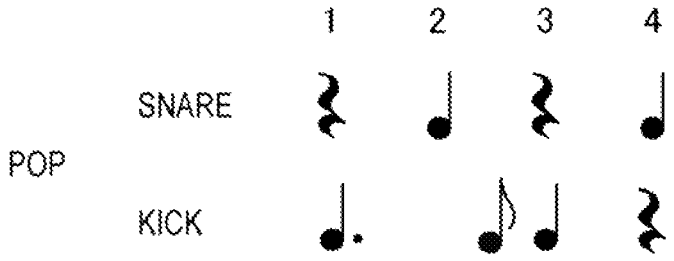
FIG. 1B is another schematic illustration for explaining the concept of the invention.
Figure 1C:
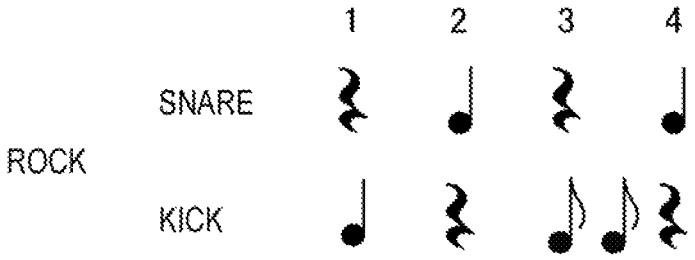
FIG. 1C is still another schematic illustration for explaining the concept of the invention.

The invention not only excludes attack sounds in a low frequency band through the HPF processing and the like as in a typical technique but also notes that a snare drum is often hit at the second and fourth beats. For instance, as shown in FIGS. 1A, 1B and 1C, the snare drum is hit at the second and fourth beats in four-on-the-floor, POP rhythm pattern and Rock rhythm pattern.

Figure 2:
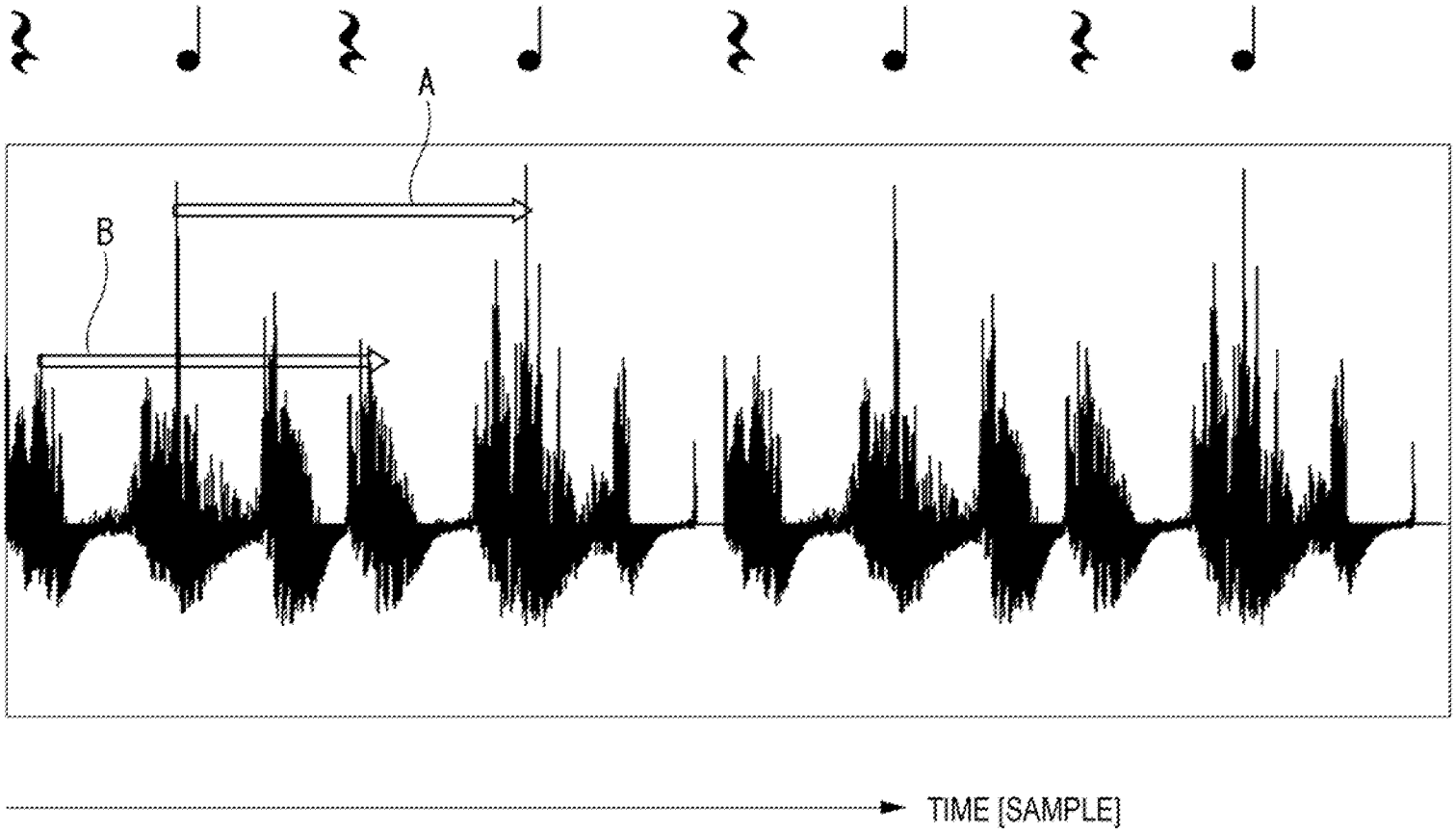
FIG. 2 is a graph for explaining the concept of the invention.

Accordingly, in an exemplary embodiment of the invention, among candidates for sounding position of the snare drum, the candidates selected with reference to a large change in a sound level, the candidates having the large change in the sound level at a two-beat interval and a four-beat interval are used as the sounding positions of the snare drum. Specifically as shown in FIG. 2, a sound level A at which a large change in the sound level is observed at a two-beat interval is identified as the sounding positions of the snare drum. However, a sound level B at which a large change in the sound level is not observed after two beats is not identified as the sounding positions of the snare drum.

2. Structure of Music Piece Analyzer 1

Figure 3:
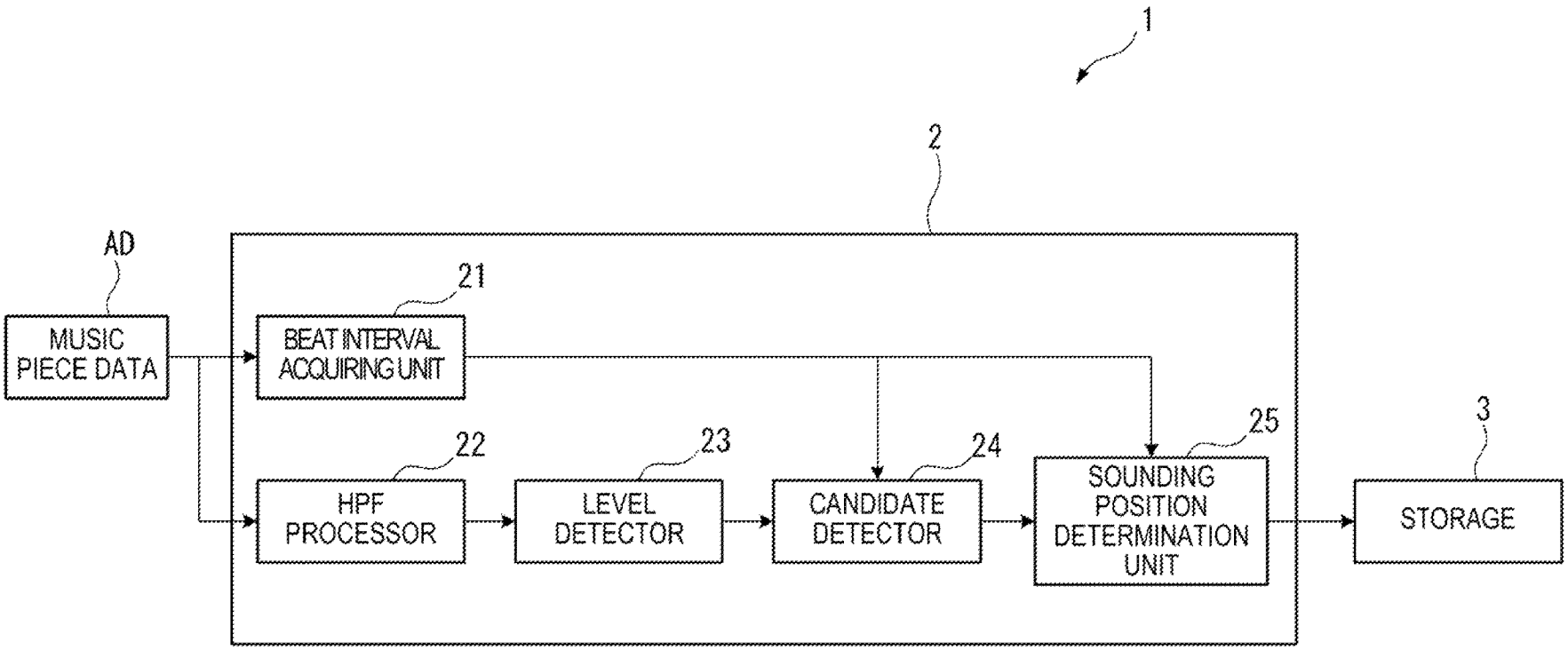
FIG. 3 is a block diagram showing a structure of a music piece analyzer according to an exemplary embodiment of the invention.

FIG. 3 shows a music piece analyzer 1 according to the exemplary embodiment of the invention. The music piece analyzer 1 is in a form of a computer including a CPU 2 and a storage 3 (e.g., a hard disc).

The music piece analyzer 1 analyzes the sounding positions of the snare drum in an inputted music piece data AD with reference to beat positions of the music piece data AD, enters the analyzed sounding positions of the snare drum in the music piece data AD, and stores the music piece data AD in the storage 3.

The music piece data AD in a form of digital data (e.g., WAV and MP3) has been analyzed in terms of the beat position of the music piece by FFT analysis and the like. The music piece data AD may be provided by importing music piece data, which has been played in a music player (e.g., CD player and DVD player), into the music piece analyzer 1 through a USB cable and the like, or may be provided by playing the digital music piece data stored in the storage 3.

The music piece analyzer 1 includes a beat interval acquiring unit 21, an HPF processor 22, a level detector 23, a candidate detector 24, and a sounding position determination unit 25, which are implemented as a music piece analysis program to be executed in the CPU 2.

The beat interval acquiring unit 21 acquires a beat interval obtained by analyzing the music piece data AD. Specifically, the beat interval acquiring unit 21 acquires, as a beat interval, a value obtained by multiplying a reciprocal number of a value of the detected BPM (Beats Per Minute) by 60 seconds. Although the beat interval is acquired from the music piece data AD having the BPM value analyzed in advance in the exemplary embodiment, the beat interval acquiring unit 21 may detect the BPM value through the FFT analysis and the like.

The HPF processor 22 subjects the music piece data AD to a HPF (Hi Pass Filter) processing, thereby excluding sounds in a low-pitch sound range (e.g., attack sounds of a bass drum) in the music piece data AD.

Figure 4:
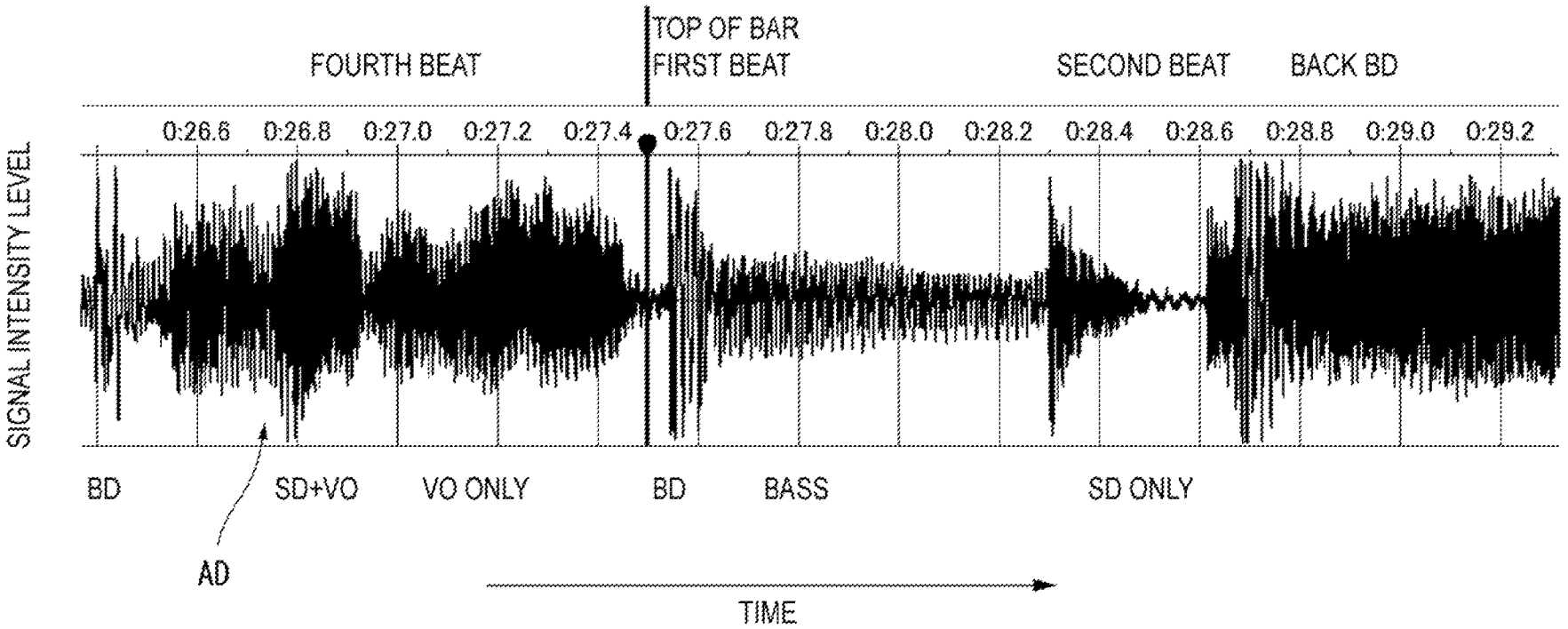
FIG. 4 is a graph showing a music piece data in terms of an intensity change over time in the exemplary embodiment.

Specifically, the HPF processor 22 subjects the music piece data AD to a ⅛ downsampling and subjects the downsampled data to the HPF processing at a cutoff frequency of 300 Hz. For instance, the HPF processor 22 excludes attack sounds of a bass drum BD and attack sounds of a bass Bass from the music piece data AD in which sounds of the snare drum SD, vocal VO, bass drum BD, bass Bass coexist as shown in FIG. 4, and extracts the attack sounds of 300 Hz or more.

The HPF processor 22 outputs the music piece data AD, which has been subjected to the HPF processing, to the level detector 23.

The level detector 23 subjects the music piece data AD, which has been subjected to the HPF processing, to the absolute-value conversion processing and, subsequently, to a smoothing processing, and detects a signal intensity level.

Figure 5:
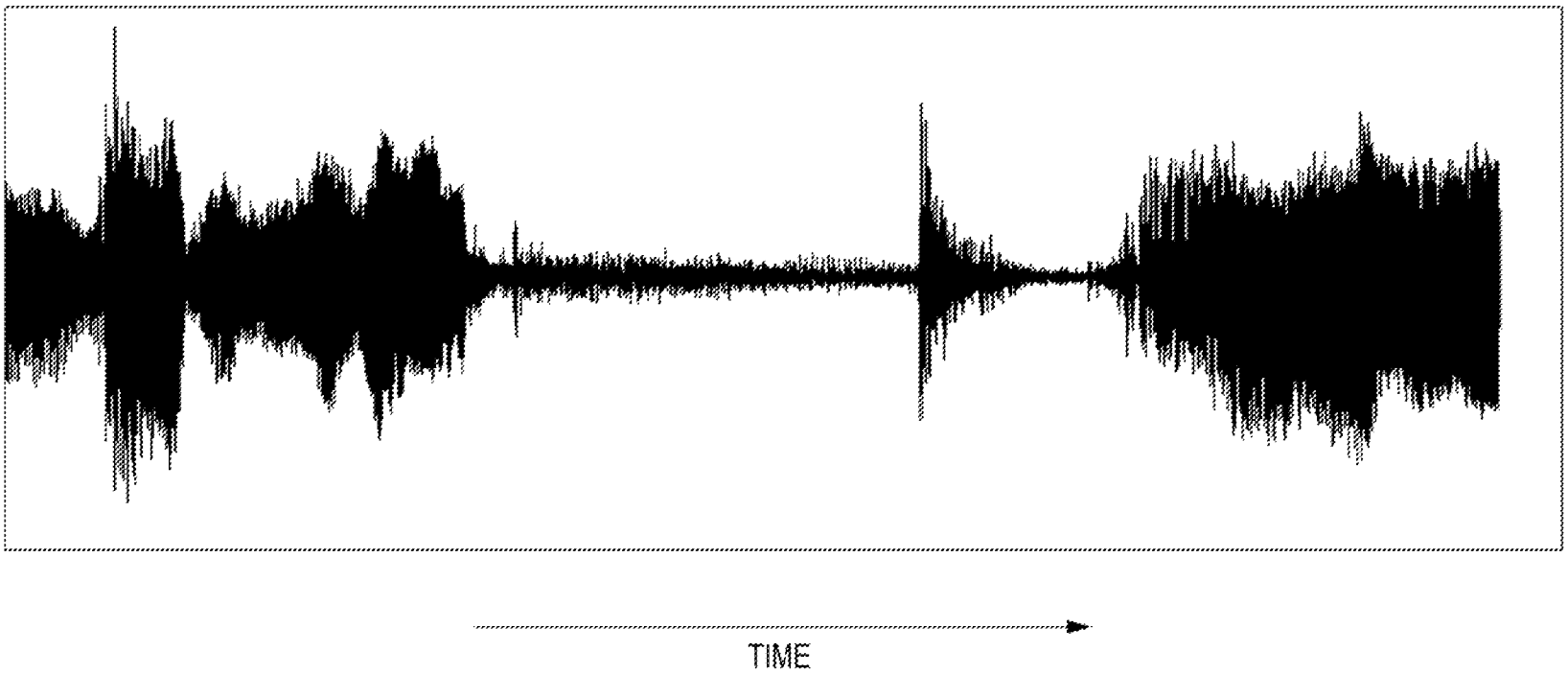
FIG. 5 is a graph showing the music piece data after being subjected to an HPF processing in the exemplary embodiment.
Figure 6:
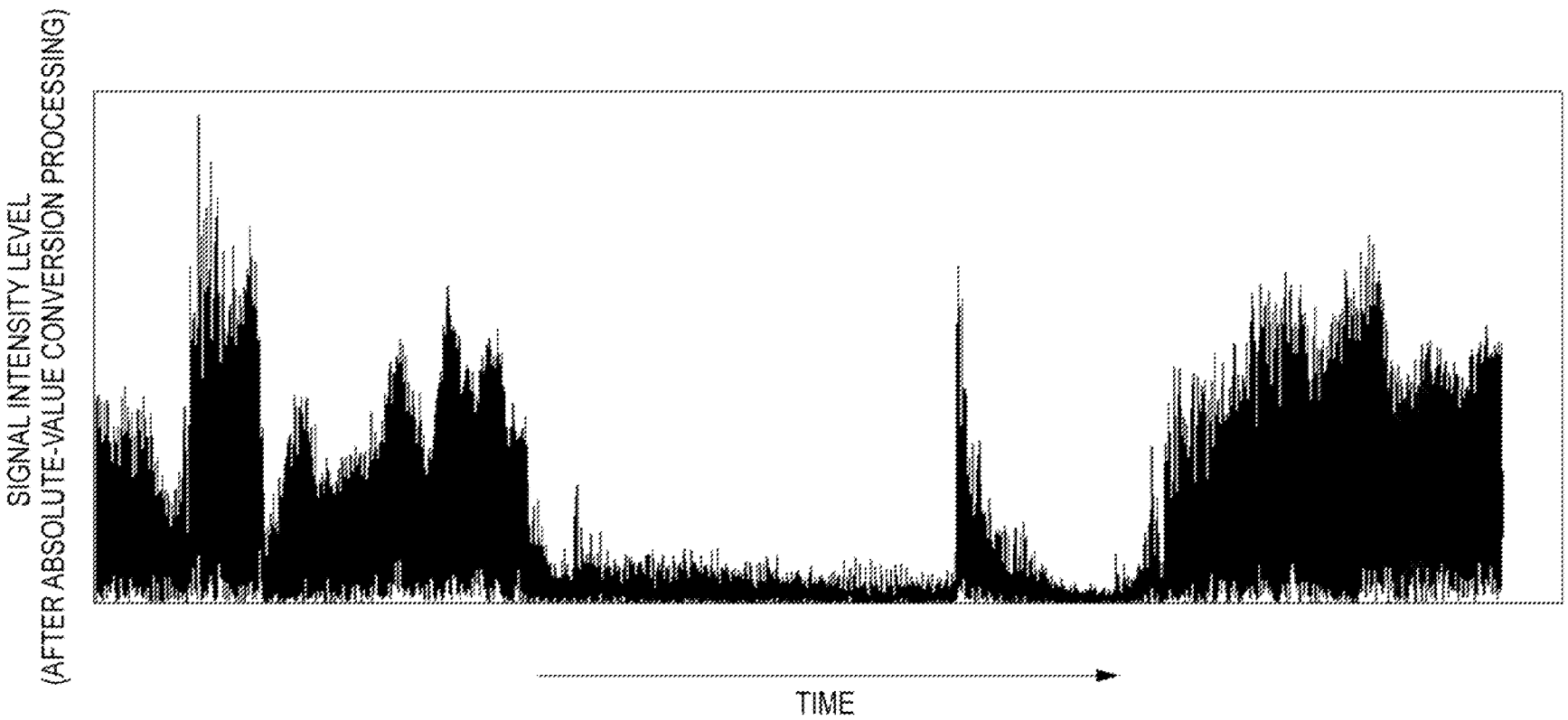
FIG. 6 is a graph showing the music piece data after being subjected to the HPF processing and then a processing of converting the obtained music piece data into an absolute value (hereinafter, simply referred to as the "absolute-value conversion processing") in the exemplary embodiment.

Specifically, after the HPF processing as shown in FIG. 5, the signal intensity level is subjected to the absolute-value conversion processing to calculate the signal intensity level in a form of the absolute value as shown in FIG. 6. Next, the level detector 23 subjects the signal intensity level in a form of the absolute value to a moving average processing or the like, thereby calculating the smoothed signal intensity level as shown in FIG. 7.

The level detector 23 outputs the smoothed signal intensity level to the candidate detector 24.

The candidate detector 24 detects sounding positions where a change amount for sounding is equal to or more than a threshold for the processing in the music piece data AD, as candidates for sounding positions of the snare drum.

Figure 7:
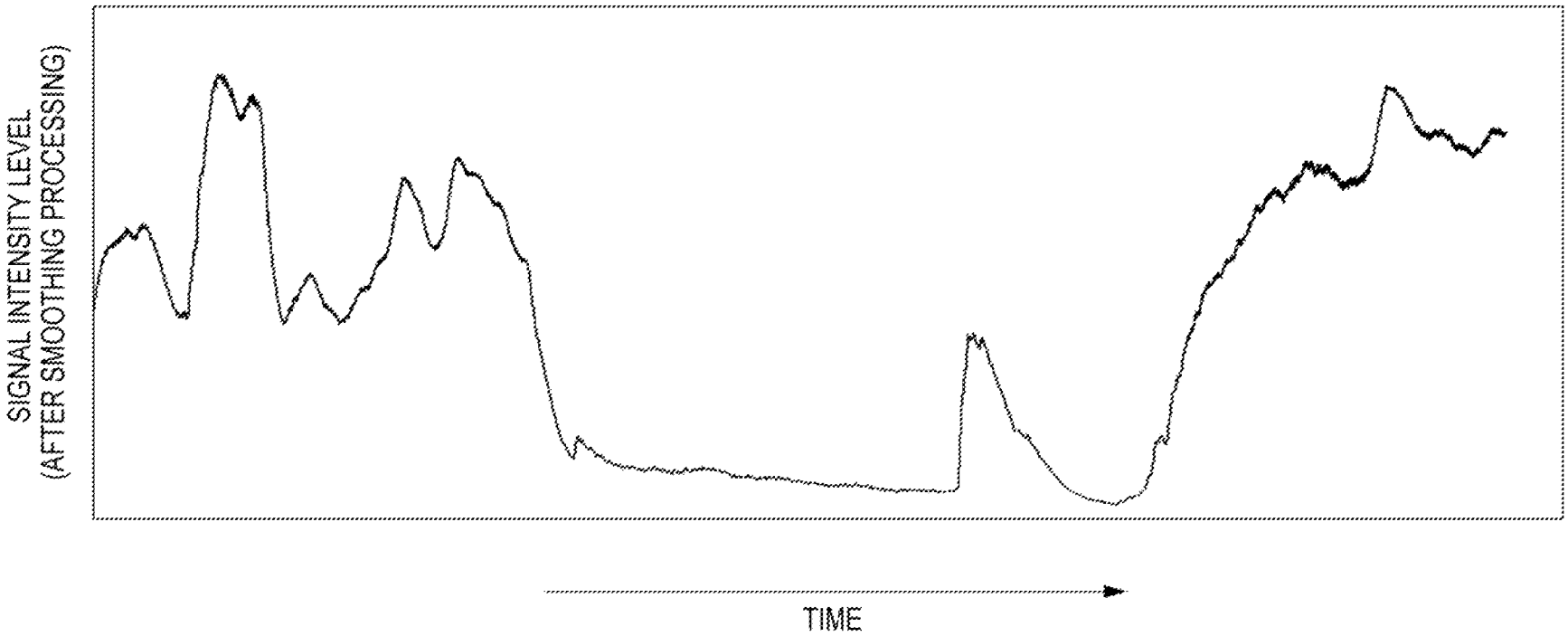
FIG. 7 is a graph showing the music piece data after being subjected to the absolute-value conversion processing and then a smoothing processing in the exemplary embodiment.
Figure 8:
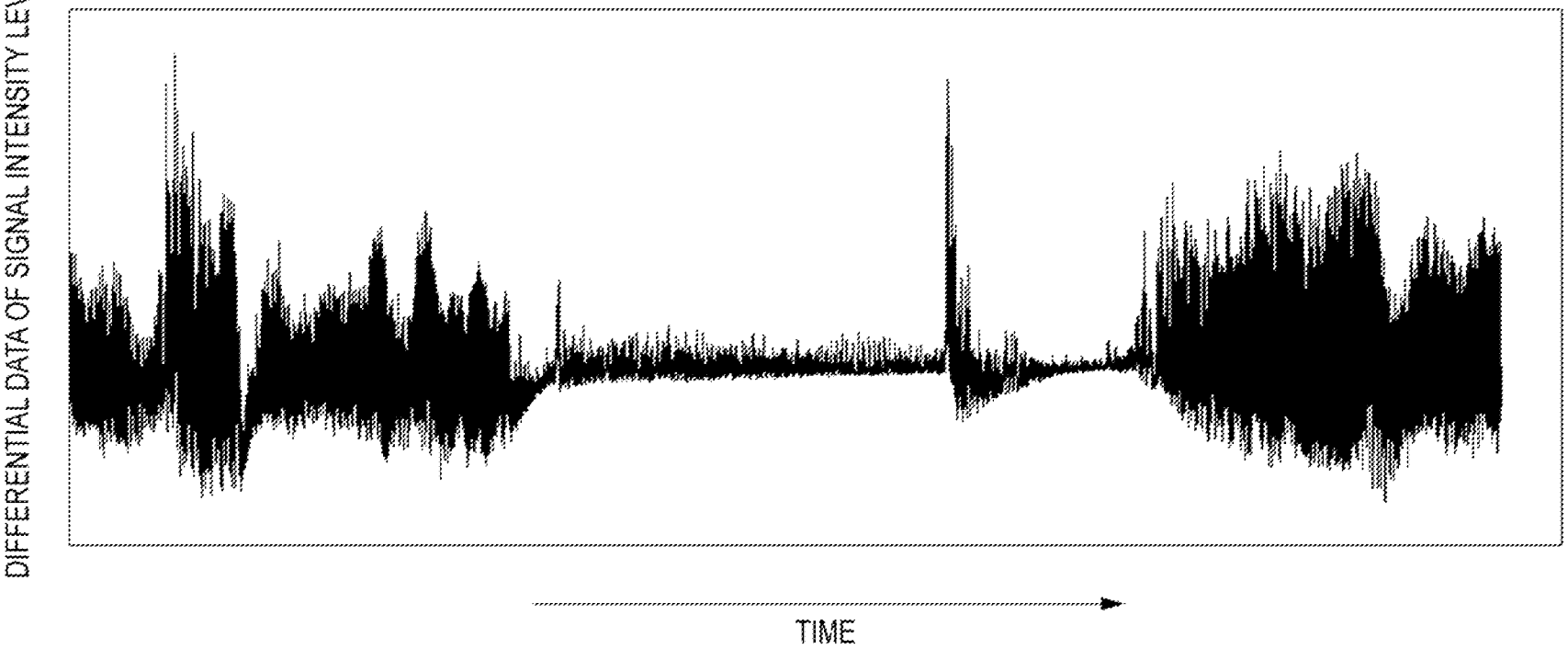
FIG. 8 is a graph showing the music piece data after being subjected to the smoothing processing and then a differentiating processing in the exemplary embodiment.

Firstly, the candidate detector 24 calculates differential data of the smoothed signal intensity level as shown in FIG. 7, thereby calculating a change amount of the signal intensity level shown in FIG. 8.

Figure 9:
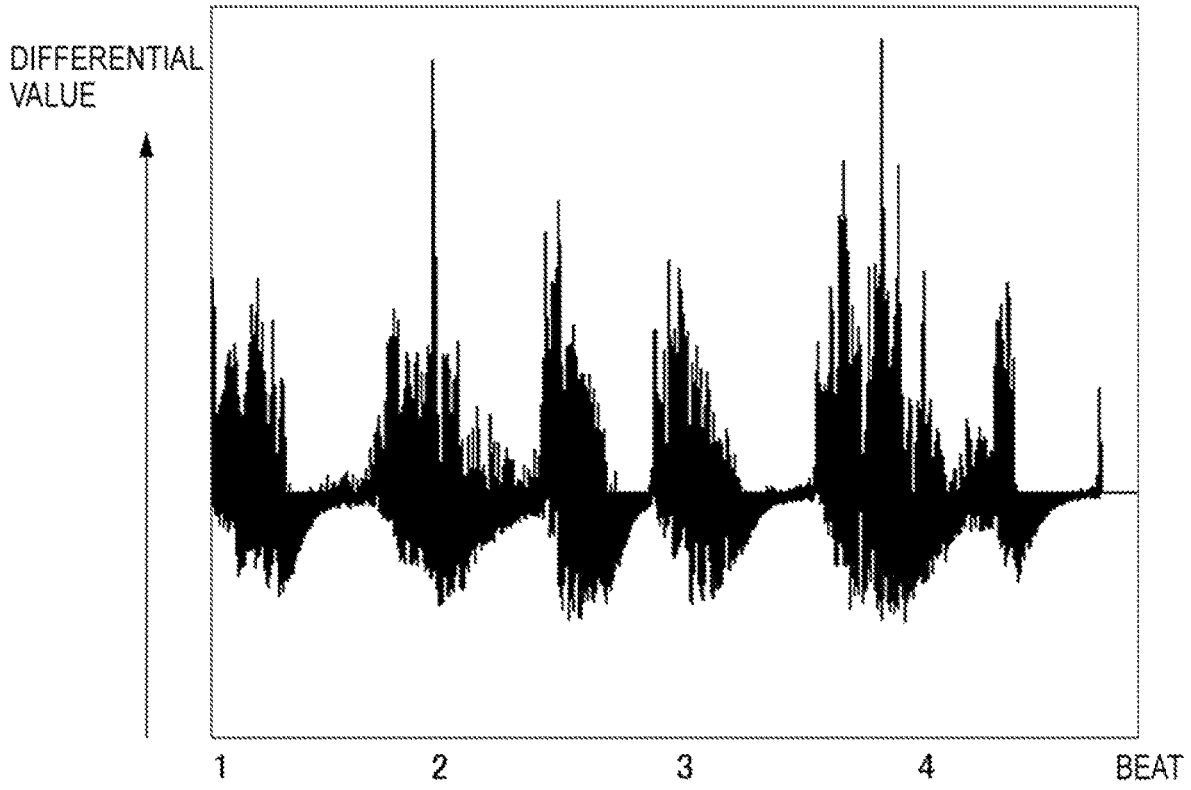
FIG. 9 is a graph obtained by dividing by four beats the graph after being subjected to the differentiating processing in the exemplary embodiment.

Next, the candidate detector 24 divides the obtained change amount of the signal intensity level by four beats into blocks, thereby acquiring differential data of the signal intensity level per four beats as shown in FIG. 9.

Figure 10:
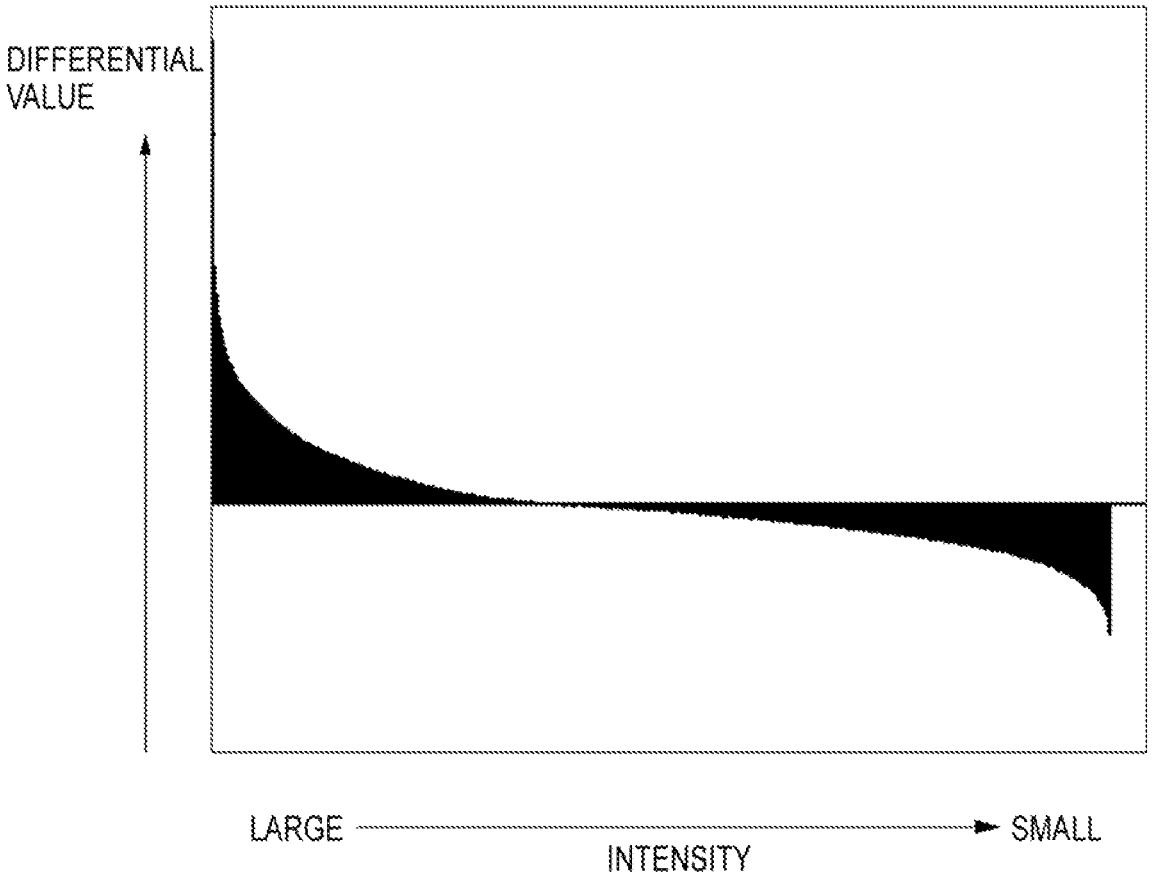
FIG. 10 is a graph obtained by sorting the graph, which has been divided by four beats in the exemplary embodiment, in terms of an intensity in a descending order.

The candidate detector 24 sorts the differential data per block in a descending order and arranges the sorted differential data in a descending order starting from the largest change amount of the signal intensity level as shown in FIG. 10.

Figure 11:
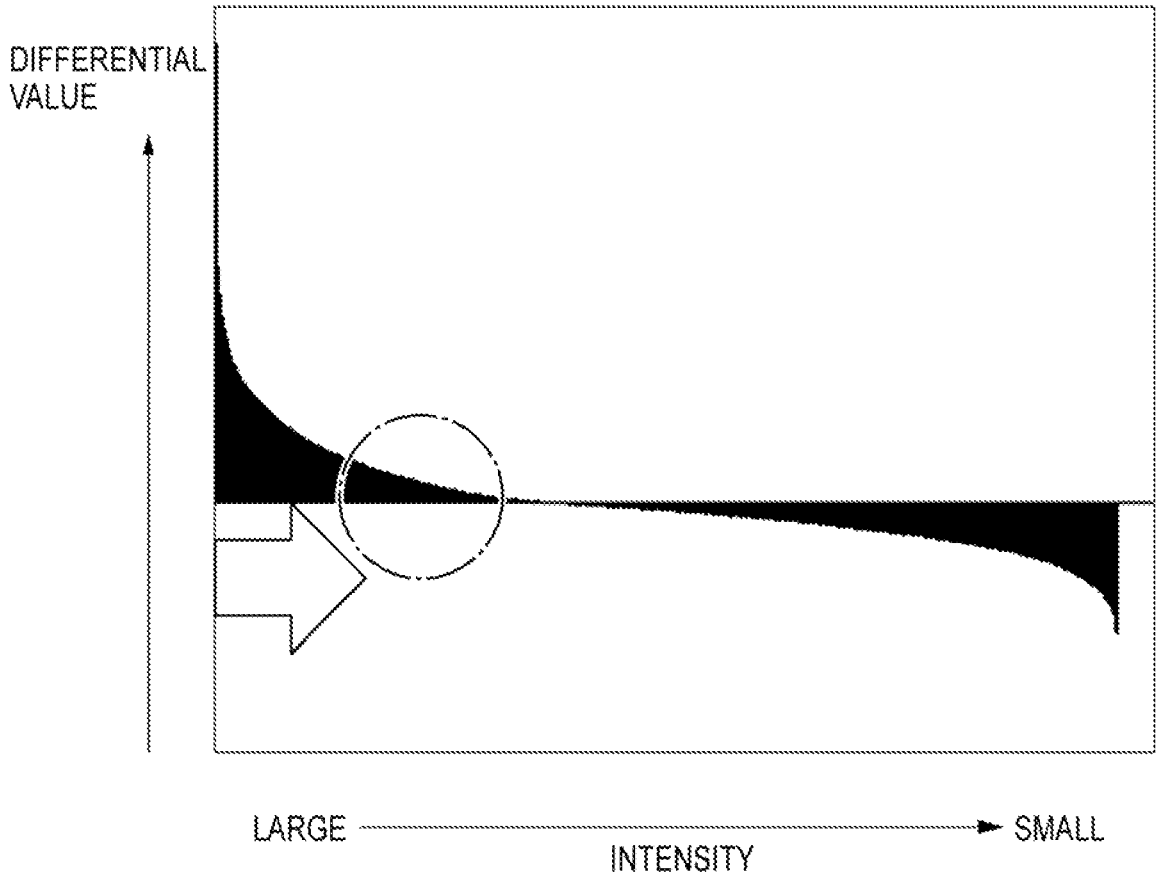
FIG. 11 is a graph showing detection of candidates for sounding positions of a snare drum in the sorted graph in the exemplary embodiment.

The candidate detector 24 picks up the sorted differential data in each block in the descending order starting from the largest change amount as shown in FIG. 11. Since the candidate detector 24 picks up the data regarding the sounding positions of the snare drum, the candidate detector 24 stores time position information on the unsorted data. In other words, the candidate detector 24 stores index information showing which sample is picked up on a basis of a magnitude of the change amount of the signal intensity level.

The candidate detector 24 terminates detecting the sounding positions as the candidates for the sounding positions of the snare drum when a difference from the next candidate in the change amount of the signal intensity level is equal to or less than a predetermined threshold.

The candidate detector 24 outputs the detected candidates for the sounding positions of the snare drum to the sounding position determination unit 25.

Among the candidates for the sounding positions of the snare drum detected by the candidate detector 24, the sounding position determination unit 25 identifies that the candidates for the sounding positions at a two-beat interval in the music piece data AD acquired by the beat interval acquiring unit 21 are the sounding positions of the snare drum.

Figure 12:
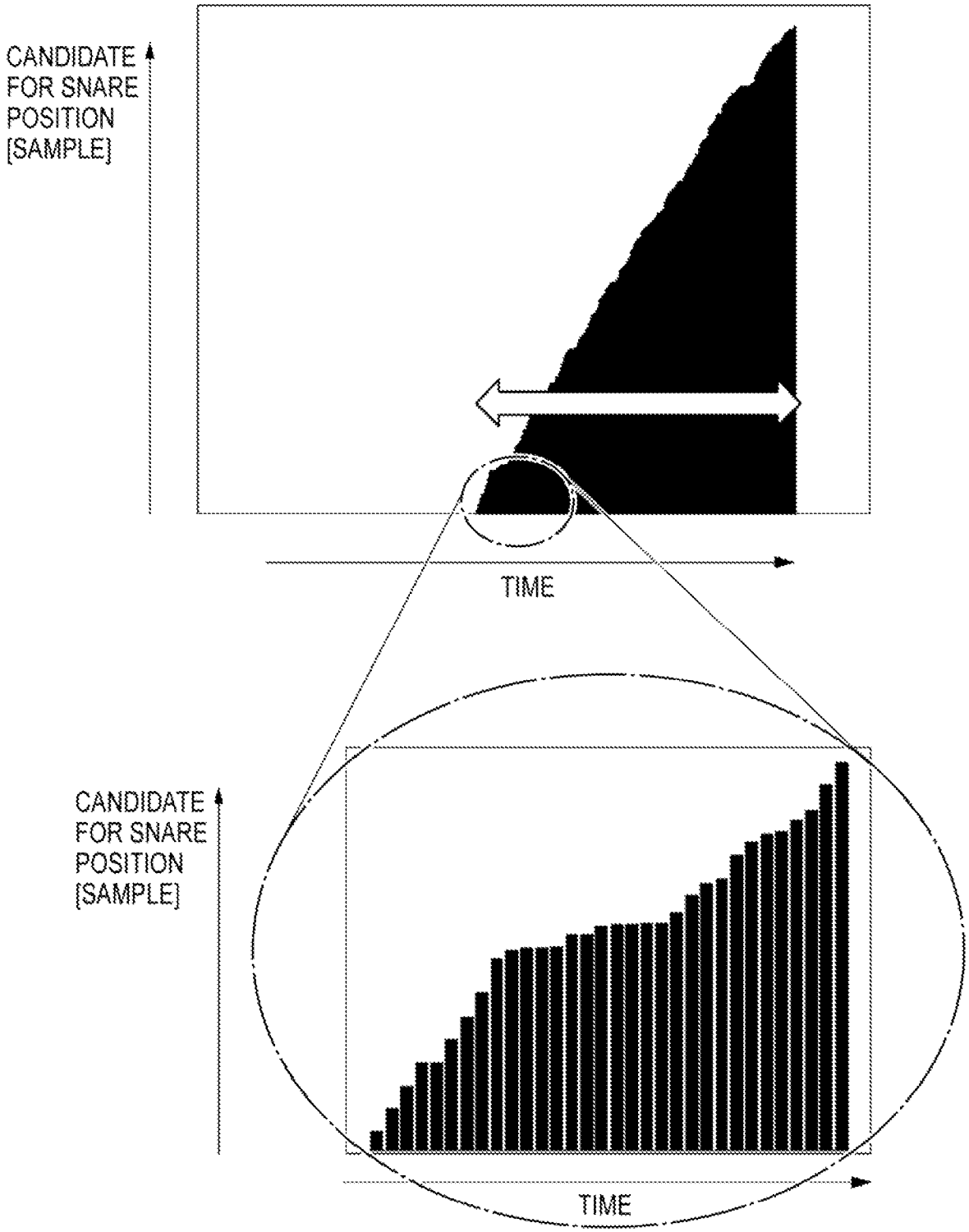
FIG. 12 shows the candidates, which has been sorted in a temporal order, for the sounding positions of the snare drum in the exemplary embodiment.

Specifically, the sounding position determination unit 25 provides data by again sorting the candidates for the sounding positions of the snare drum in a temporal order as shown in FIG. 12.

Next, among the candidates for the sounding positions of the snare drum, the sounding position determination unit 25 excludes the candidates for the sounding positions where no change amount of the signal level is observed at a two-beat interval and a four-beat interval, on a basis of the beat interval acquired by the beat interval acquiring unit 21.

The sounding position determination unit 25 determines that only the candidates for the sounding positions where the change amount of the signal level is observed at a two-beat interval and four-beat interval are the sounding position of the snare drum.

The sounding position determination unit 25 performs the above operation on all the blocks to specify the sounding positions of the snare drum in the music piece data AD.

The sounding position determination unit 25 enters the identified sounding positions of the snare drum into the music piece data AD, and stores the music piece data AD in the storage 3.

3. Operations and Advantages in Exemplary Embodiment

Figure 13:
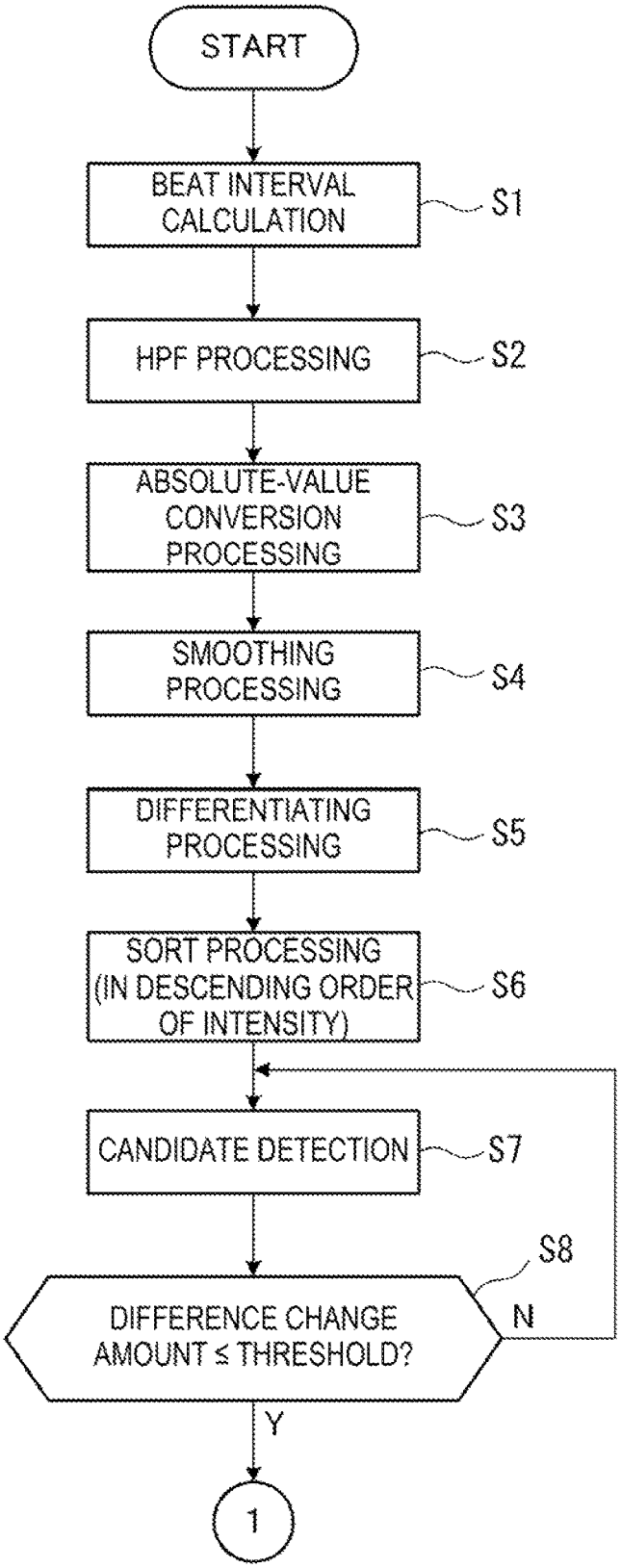
FIG. 13 is a flowchart for explaining operations in the exemplary embodiment.
Figure 14:
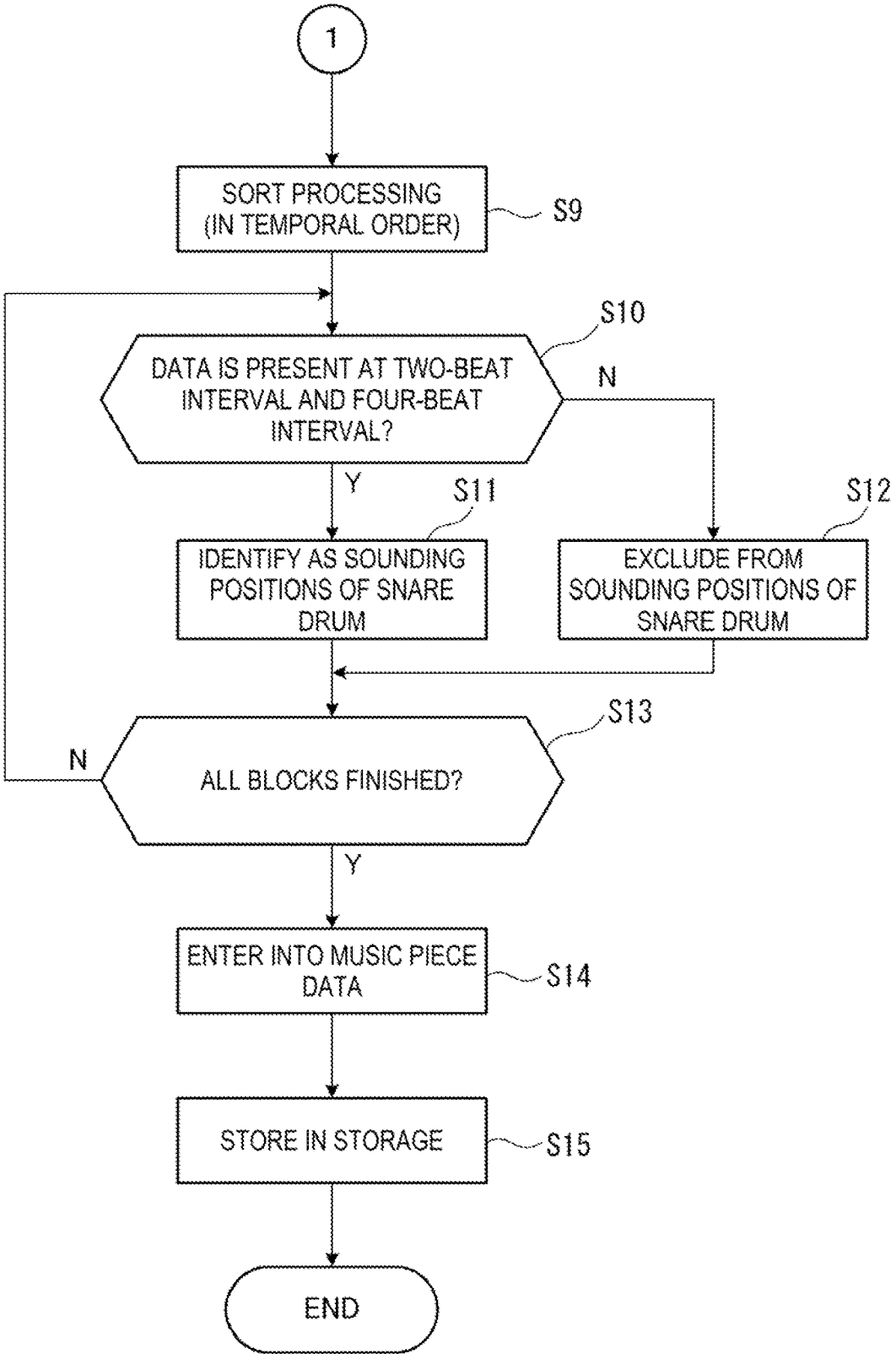
FIG. 14 is a next flowchart for explaining the operations in the exemplary embodiment.

Next, operations in the exemplary embodiment will be described with reference to flowcharts shown in FIGS. 13 and 14.

The beat interval acquiring unit 21 acquires a beat interval of the music piece data AD (Step S1).

The HPF processor 22 subjects the music piece data AD to the HPF processing, thereby excluding sounds in a low-pitch sound range (e.g., attack sounds of a bass drum) in the music piece data AD (Step S2).

The level detector 23 subjects the HPF-processed signal intensity level to the absolute-value conversion processing, thereby calculating the signal intensity level in a form of an absolute value (Step S3).

The level detector 23 subjects the signal intensity level in a form of the absolute value to the smoothing processing (Step S4).

The candidate detector 24 calculates differential data of the smoothed signal intensity level, thereby calculating the change amount of the signal intensity level (Step S5).

The candidate detector 24 divides the change amounts of the signal intensity levels by four beats into blocks and sorts the differential data of the signal intensity level in each block in a descending order starting from the largest change amount (Step S6).

The candidate detector 24 sequentially detects sounding positions in an order starting from the sounding position having the largest signal intensity level, as the candidates for the sounding positions of the snare drum (Step S7).

The candidate detector 24 judges whether a difference in the change amount of the signal intensity level becomes equal to or less than a predetermined threshold (Step S8).

The candidate detector 24 continues to detect another candidate when the difference in the change amount is not equal to or less than the predetermined threshold.

The candidate detector 24 terminates detecting the candidates for the sounding positions of the snare drum when the difference in the change amount becomes equal to or less than the predetermined threshold.

The sounding position determination unit 25 sorts, in a temporal order, the candidates for the sounding positions of the snare drum detected by the candidate detector 24 (Step S9).

The sounding position determination unit 25 judges whether data on the change amounts of the signal levels sorted in a temporal order includes data on the change amount of the signal level at two-beat intervals before and after a current target candidate (Step S10).

When data on the change amount of the signal level at the two-beat interval and the four-beat interval exists, the sounding position determination unit 25 determines the data as the candidates for the sounding positions of the snare drum (Step S11).

However, when no data on the change amount of the signal level at the two-beat interval and the four-beat interval exists, the sounding position determination unit 25 excludes the data from the sounding positions of the snare drum (Step S12).

The sounding position determination unit 25 determines the sounding positions of the snare drum in the data of all the divided blocks (Step S13).

After determining the data of all the blocks, the sounding position determination unit 25 enters the sounding positions of the snare drum into the music piece data AD (Step S14).

The sounding position determination unit 25 stores the music piece data AD, in which the sounding positions of the snare drum is entered, in the storage 3 (Step S15).

According to the exemplary embodiment, the sounding position determination unit 25 determines that only the data with the change amounts of the signal levels at two-beat interval and four-beat interval are the sounding positions of the snare drum. Since the sounding positions at the second and fourth beats, which are characteristic of the snare drum, are thus identified as the sounding positions of the snare drum, a possibility of erroneously detecting the sounding positions of the snare drum is reducible.

Since the sounding positions of the snare drum are determined after the HPF processor 22 subjects the music piece data AD to the HPF processing, sounds in a low-pitch sound range (e.g., attack sounds of a bass drum and a bass) are excludable, so that the sounding positions of the snare drum can be more highly accurately identified.

In the step of determining whether to exclude the candidates, the determination can be further more accurately performed by checking the data not only at the two-beat interval before the candidates but also at the two-beat interval after the candidates.

Since the candidate detector 24 acquires the differential data as a unit of the block per four beats in the music piece data AD, the signal level having a large change amount at the second beat and the fourth beat in the music piece data AD can be easily specified, thereby facilitating identifying the sounding positions of the snare drum.

The invention claimed is:

1. A music piece analyzer comprising:

a beat interval acquiring unit configured to acquire a beat interval of music piece data;

a candidate detector configured to detect sounding positions where a change amount for sounding is equal to or more than a predetermined threshold in the music piece data, as candidates for sounding positions of a snare drum; and a sounding position determination unit configured to determine that the candidates for the sounding positions at a two-beat interval calculated by the beat interval acquiring unit in the music piece data are the sounding positions of the snare drum, among the candidates for the sounding positions of the snare drum.

2. The music piece analyzer according to claim 1, wherein the sounding position determination unit determines the sounding positions of the snare drum on a basis of the sounding positions of the candidates at two-beat intervals before and after the candidates.

3. The music piece analyzer according to claim 1, further comprising:

a high pass filter (HPF) processor configured to subject the music piece data to a high pass filter (HPF) processing.

4. The music piece analyzer according to claim 1, wherein the candidate detector acquires differential data of the music piece data in a block per four beats of the music piece data to acquire the change amount.

5. A computer-readable medium that stores a program code configured to enable a computer to function as:

when read and run by the computer a beat interval acquiring unit configured to acquire a beat interval of music piece data;

a candidate detector configured to detect sounding positions where a change amount for sounding is equal to or more than a predetermined threshold in the music piece data, as candidates for sounding positions of the snare drum; and a sounding position determination unit configured to determine that the candidates for the sounding positions at a two-beat interval acquired by the beat interval acquiring unit in the music piece data are the sounding positions of the snare drum, among the candidates for the sounding positions of the snare drum.

* * * * *